US006681675B2

(12) United States Patent
Miller

(10) Patent No.: US 6,681,675 B2
(45) Date of Patent: Jan. 27, 2004

(54) REMOTE HAZARDOUS DEVICES INTERDICTION PROCESS AND APPARATUS

(75) Inventor: Paul L. Miller, Harvest, AL (US)

(73) Assignee: Teledyne Brown Engineering, Inc., Huntsville, AL (US)

( * ) Notice: Subject to any disclaimer, the term of this patent is extended or adjusted under 35 U.S.C. 154(b) by 0 days.

(21) Appl. No.: 10/022,215

(22) Filed: Dec. 20, 2001

(65) Prior Publication Data

US 2002/0112598 A1 Aug. 22, 2002

Related U.S. Application Data

(63) Continuation-in-part of application No. 09/797,852, filed on Mar. 5, 2001.

(60) Provisional application No. 60/186,673, filed on Mar. 3, 2000.

(51) Int. Cl.[7] ..... F42B 33/06

(52) U.S. Cl. ..... 86/50; 102/402; 102/293; 588/202; 588/261

(58) Field of Search ..... 86/50

(56) References Cited

U.S. PATENT DOCUMENTS

| | | | |
|---|---|---|---|
| 2,340,945 | A | 2/1944 | Ellick |
| 3,594,890 | A | 7/1971 | Cordell |
| 3,771,413 | A | 11/1973 | Sieg et al. |
| 4,046,055 | A | 9/1977 | McDanolds et al. |
| 4,169,403 | A | 10/1979 | Hanson |

(List continued on next page.)

OTHER PUBLICATIONS

Jetedge.com, Jet Edge, Jan. 31, 1997, Jet Edge.*

Hugh Jack, Manufacturing Engineer on a disk, Apr. 20, 1998, Hugh Jack, pp. 6–9.*

Jetedge.com, Hydro–Crawler, Dec. 22, 1999, Jet Edge.*

"WaterJetCutting Abrasive Cutting WaterJet Jet Cutting Water Cutting ANT AG", Applied New Technologies AG, pulled from the internet on Mar. 10, 2002, http://WWW.ant–ag.net/en/set_home.html, 2 pages.

"DiaJet Osprey", pulled from the internet on Mar. 10, 2002, http://www.phrgroup.comuk/diajet/osprey.htm, 4 pages.

"WWW Links (Humanitarian Demining)—ExtendedRef", pulled from the internet on Mar. 11, 2002, http://Diwww.epfl.ch/lami/detec/minelinks.html, 17 pages.

"Disposal of Conventional Ordnance", pulled from the internet on Mar. 10, 2002, http://aai.business.israel.net/eod/3.htm, 4 pages.

"Site Map for WJTC (Under Construction)", pulled from the internet on Mar. 10, 2002, http://grpweb.gintic.gov.sg/~wjweb/Site%20Map/Site%20page%201.html, 3 pages.

"Applications", pulled from the internet Mar. 10, 2002, http://grpweb.gintic.gov.sg/~wjweb/Applications/Applications page 1.html, 10 pages.

"Mobile Disrupter Vehicle", article found at http://www.inuktun.com, 4 pages.

(List continued on next page.)

*Primary Examiner*—Charles T. Jordan
*Assistant Examiner*—Bret Hayes
(74) *Attorney, Agent, or Firm*—Smith, Gambrell & Russell, LLP

(57) ABSTRACT

A method for remotely accessing packages suspect of containing hazardous devices. The method includes using a continuous stream of high velocity abrasive particles and/or fluid(s) created in-situ while attached to a remotely or autonomously operated vehicle to breach the exterior surface of a suspect package well below the impact initiation threshold thus preventing sufficient stimuli to initiate explosive, pyrotechnic, or flammable materials. An automatic standoff device may be used to allow the operator of a remotely operated vehicle or the feedback mechanism of an autonomously operated vehicle to optimally locate the abrasive fluid stream.

54 Claims, 4 Drawing Sheets

U.S. PATENT DOCUMENTS 4,201,368 A 5/1980 Vetter
4,437,525 A * 3/1984 O'Hanlon et al. ..... 175/218
4,493,239 A 1/1985 Pedersen
4,589,341 A 5/1986 Clark et al.
4,621,562 A 11/1986 Carr et al.
4,768,709 A * 9/1988 Yie ..... 175/67
4,779,511 A 10/1988 Proctor et al.
4,786,848 A * 11/1988 Nickerson ..... 29/404
4,817,653 A * 4/1989 Krajicek et al. ..... 134/168 R
4,826,087 A * 5/1989 Chinery ..... 239/551
4,836,079 A 6/1989 Barrett
4,840,105 A 6/1989 Ladan et al.
4,854,982 A 8/1989 Melvin et al.
4,909,152 A 3/1990 Reuter
4,919,034 A 4/1990 Firth
4,932,831 A 6/1990 White et al.
4,955,939 A 9/1990 Petrousky et al.
4,957,027 A 9/1990 Cherry
5,007,325 A 4/1991 MacWatt
5,134,921 A 8/1992 Breed et al.
5,136,920 A 8/1992 Breed et al.
5,140,891 A 8/1992 Husseiny et al.
5,203,646 A * 4/1993 Landsberger et al. .... 104/138.2
5,210,368 A 5/1993 Heller, Jr. et al.
5,223,661 A 6/1993 Sabri
5,223,666 A 6/1993 Delaney, Jr.
5,249,500 A 10/1993 Husseiny et al.
5,301,594 A 4/1994 Argazzi et al.
5,353,676 A 10/1994 King et al. ..... 86/50
5,363,603 A 11/1994 Miller et al.
5,386,758 A 2/1995 Conley
5,430,229 A 7/1995 Voss
5,448,936 A 9/1995 Turner
5,452,639 A 9/1995 Aulenbacher et al.
5,460,154 A 10/1995 Mattern et al. ..... 124/56
5,516,970 A 5/1996 Miller et al.
5,527,204 A * 6/1996 Rhoades ..... 451/39
5,574,203 A 11/1996 Noel et al.
5,657,676 A 8/1997 Koller
5,728,967 A 3/1998 Parkes
5,737,709 A 4/1998 Getty et al.
5,743,246 A 4/1998 Mattern
5,770,913 A * 6/1998 Mizzi ..... 310/20
5,785,038 A 7/1998 Mattern
5,859,372 A * 1/1999 Neltoft ..... 250/221
5,936,184 A 8/1999 Majerus et al.
5,979,289 A 11/1999 French
5,987,723 A 11/1999 McNally et al.
5,988,038 A 11/1999 Feintuch ..... 89/1.13
6,080,907 A 6/2000 Miller ..... 588/202

OTHER PUBLICATIONS

"Appendix G—Fluid–Jet Cutting of Ordnance and High–Pressure Clean–Out of Energetic Materials", the Nat'l Academy Press, 1999, pp. 235–239; pulled from the internet Jun. 6, 2001, http://books.nap.edu/books.nap.edu/books/0309066395/html.

"Petroleum Place: Oil & Gas Business Directory: Abrasive Cutting", pulled from the internet Mar. 10, 2002, http://www.petroleumplace.com/BusinessDirectory/AbrasiveCutting/.

"New Technology Revolutionizes War Material Removal and Bomb Defusing", "Waterjet Use Dealing With the Problem of Anti–Personnel Landmines", D.A. Summers, et al., 10$^{th}$ American Waterjet Conference Aug. 14–17, 1999, 10 pages.

"Other Detection Technologies Workshop", pulled from the internet Mar. 10, 2002, http://www.uxocoe.brtrc.com/WorkshopNote/otherdetect.htm, 17 pages.

"Manufacturing Engineer on a disk", Version 1.0 Aug. 31, 2001, pulled from the internet Mar. 30, 2002, http://claymore.engineer.gvsu.edu/~jackh/eod/manufact/manufact–272.html.

"Colt Product Range", various illustrations pulled from the internet Oct. 29, 2002 and Nov. 6, 2002, 30 pages.

"Demilitarization Services", ATK Thiokol Propulsion Demilitarization Services, 2002, 1 page, pulled from the internet Nov. 6, 2002, http://www.thiokol.com/demil/htm. various illustrations pulled from the internet Oct. 29, 2002, 22 pages.

"The Website for Defense Industries—Army", pulled from the internet Oct. 29, 2002, http://www.army–technology-.com/contractors/mines/remotec/.

* cited by examiner

REMOTE HAZARDOUS DEVICES INTERDICTION PROCESS AND APPARATUS

The application is a continuation-in-part under 35 U.S.C. §120 of copending U.S. patent application Ser. No. 09/797,852 filed on Mar. 5, 2001, which claims priority under 35 U.S.C. §119(e) from U.S. Application No. 60/186,673 filed on Mar. 3, 2000 and each of these applications are incorporated by reference.

BACKGROUND OF THE INVENTION

The present invention relates to accessing hazardous devices, and more particularly to a method for the safe and remote access and disruption of packages suspected to contain hazardous devices, chemicals, and/or initiating circuits, using a continuous stream of high pressure liquid, gel, or emulsion. The continuous stream is capable of disrupting the initiating system while not presenting sufficient stimuli to initiate explosive, pyrotechnic, or flammable materials.

Many items, suspected of containing hazardous devices, are discovered in the United States everyday. It is the objective of explosive ordnance disposal (EOD) and bomb squad personnel to access these items and ascertain the contents and the relative hazard these contents present. Many of these items must be remotely opened using explosive disassembly techniques or explosively accelerated projectiles known as "dynamic devices."

These devices are, by nature, "one-shot" units that are capable of firing only once before reloading. Due to the potential hazards associated with moving a potentially hazardous device, the energetic disrupter must be used in-situ and the collateral damage to structures and vehicles accepted as a necessary cost of operations. In some instances, such as large vehicle bombs, no remote accessing technology exists that will allow the technician to remotely open the vehicle without applying an excessive amount of force.

The large application of force often is sufficient in and of itself to initiate the hazardous device or to trigger the initiation mechanism. What is required by the technicians is a remotely operated device that can safely open items of various compositions without the application of excessive force in order to minimize collateral damage and to minimize the potential of accidental initiation of a hazardous item.

The use of high-pressure water to cut explosive-loaded ordnance is a proven technology. A review of this technology is given in "Review and Evaluation of Alternative Technologies for Demilitarization of Assembled Chemical Weapons," Committee on Review and Evaluation of Alternative Technologies for Demilitarization of Assembled Chemical Weapons, National Research Council, 1999.

U.S. Pat. No. 5,988,038 describes an apparatus and method for destroying buried objects, such as mines. The device shoots a projectile, such as a bullet, into the buried mine essentially destroying the mine on impact. U.S. Pat. No. 5,460,154 describes an apparatus for pneumatically propelling a projectile substance. This device is designed like a pneumatic gun and propels a single projectile substance into an explosive device. In addition, U.S. Pat. No. 5,353,676 describes an apparatus which employs a shearing means, such as a blade, for disassembling a failed explosive device. However, the above mentioned apparatuses can cause the device to explode or are designed to only discharge one projectile at a time resulting in wasted time reloading the apparatus or waiting for the apparatus to recharge. None of the previous devices employ a continuous stream of high velocity abrasive particles and/or fluid(s) for safely deactivating a hazardous device.

U.S. Pat. No. 6,080,907 describes ammonia fluid jet cutting. However, these fluid jet cutting techniques have been focused on the demilitarization of conventional and chemical military munitions. The only known methods for deactivation of hazardous devices such as large vehicle bombs are (1) EOD personnel and (2) explosive disruption techniques.

BRIEF SUMMARY OF THE INVENTION

The present invention relates to a method for remotely accessing packages containing hazardous devices using a continuous stream of high velocity abrasive particles and/or fluid(s). The stream is created in-situ while attached to a remotely or autonomously operated vehicle. The object of the invention is accomplished by means of a high pressure fluid being converted to high velocity through an appropriately sized orifice aspirating an abrasive stream from a mixing chamber. In this design, optimal focusing of the high velocity abrasive particle solution onto the exterior surface of the hazardous device is achieved at a controlled speed and impact area which is below the impact initiation threshold of the hazardous device.

This invention provides an apparatus design for the safe and remote access of packages suspected to contain hazardous devices, chemicals, and/or initiating systems (fuses, detonators, timers, or triggering devices) using a continuous stream of a high pressure liquid, gel, or emulsion capable of disrupting the initiating systems while not presenting sufficient stimuli to initiate explosive, pyrotechnic, or flammable materials. This apparatus is intended to be used on a remotely operated vehicle, but could also be used as a hand-held device or as a personnel operated piece of equipment.

The process of accessing the hazardous devices can be enhanced by the use of an automatic standoff device such as a commercially available proximity sensor (mechanical, optical, acoustic, etc.) which allows the operator of the remotely operated vehicle or the feedback mechanism of a pre-programmed robotic vehicle to locate the cutting nozzle for the abrasive fluid stream at an optimum standoff distance.

The system is an autonomous unit and contains all the components and support equipment necessary to operate the system. The system can be deployed to the location of a suspected hazardous device and operated without utility power or any additional support vehicles. The system can be deployed with or without a hazardous duty robot.

In operation a hazardous device can be breached by directing a high-velocity hydroabrasive stream from the fluid jet cutting nozzle onto the exterior of the hazardous device container. For certain hazardous devices, such as a pipe bomb, the device can be safely disabled using this fluid jet cutting system. For large hazardous devices, such as a vehicle bomb, this fluid jet cutting system can be used to safely access the vehicle interior allowing the EOD squad to more thoroughly assess the hazardous device.

The cutting nozzle can be mounted on a robot that is capable of directing the hydroabrasive stream to a desired point. Optionally, the cutting nozzle can be mounted on a commercially available programmable x-y stage and deployed to the target by a robot or can be manually-deployed. The robot/cutting nozzle is remotely controlled to allow operation at a safe distance.

The invention provides a remote hazardous device interdiction apparatus which employs a fluid jet cutting nozzle; an abrasive feed system; a high pressure flexible hose; a hose reel; a high pressure intensifier; a power generator supply for electric power; a water reservoir; and an air compressor.

The instant invention further provides a method for the interdiction of remote hazardous devices which employs the apparatus.

In one embodiment of the invention the pressurization of water is performed using a remote high pressure pump of commercial origin and the pressurized water (50,000 lbs. per sq. in.) is conveyed through a flexible hose or conduit that is stored autonomously with the other equipment contributing to the invention including an intensifier for maintaining the pressurization of water; a water supply reservoir; an air compressor for assisting in the water pressurization; a feedback loop from the intensifier to the water supply reservoir for excess water collection and transfer; and a generator set for providing the necessary power required for operation.

A small diameter diamond orifice located in a cutting nozzle is used to increase the water flow to one of continuous high velocity and is connected to the flexible hose remotely from the aforementioned equipment. The orifice can have a diameter varying from 0.007 inch to 0.014 inch.

In an alternative embodiment of the invention, the pressurized water feeds into a hazardous duty robot before exiting at the cutting nozzle. This design allows for remote operation in locating and focusing the high velocity water onto a suspect package.

In yet another embodiment of the invention the cutting nozzle is mounted on an automatic standoff device, an x-y programmable stage, located on the hazardous duty robot. This design allows remote optimal focusing of the high velocity water at a controlled speed and impact area on the exterior of the suspect package.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE INVENTION

Figure 1:
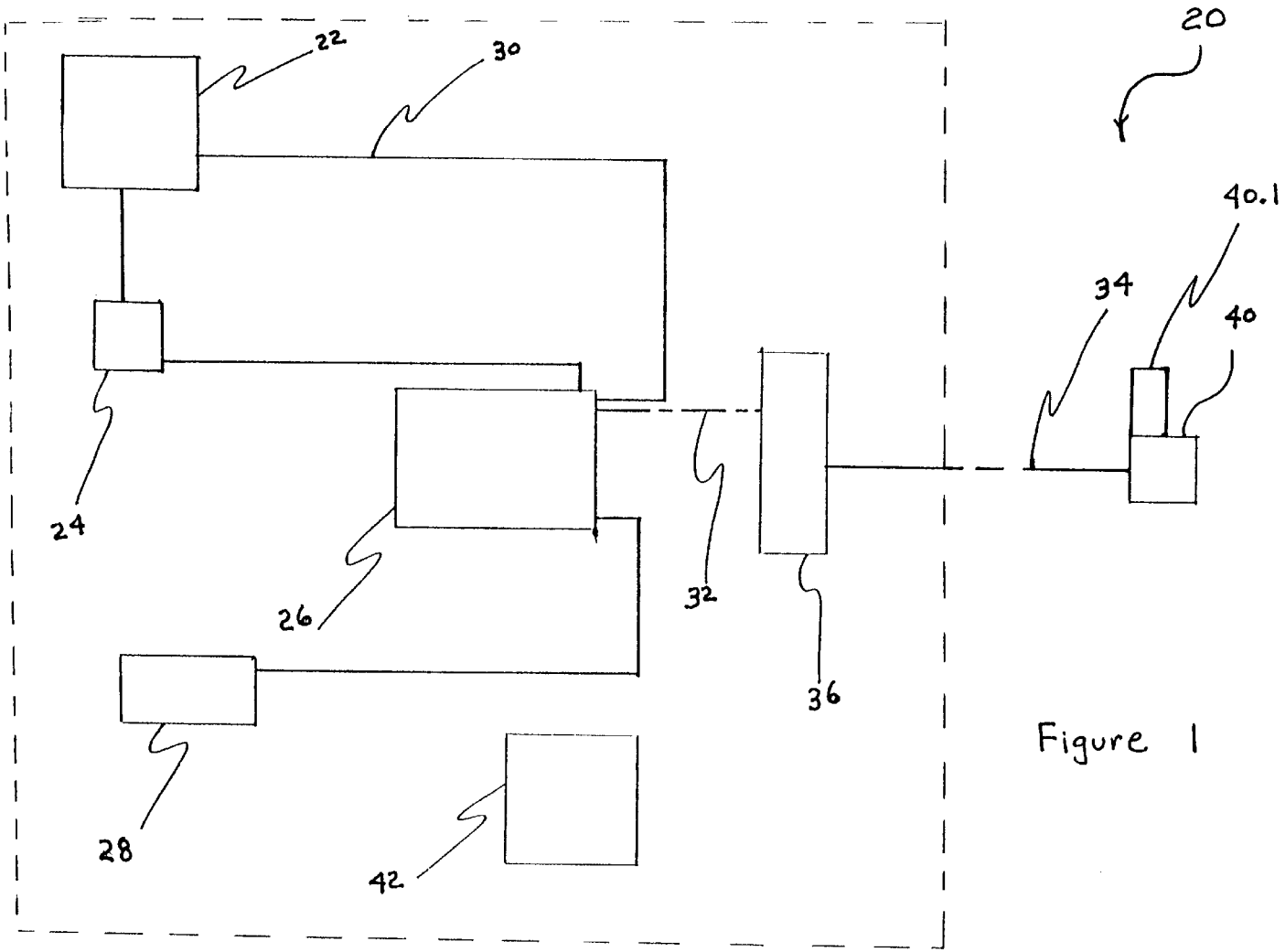
FIG. 1 shows a block diagram of an embodiment of the invention.
Figure 1A:
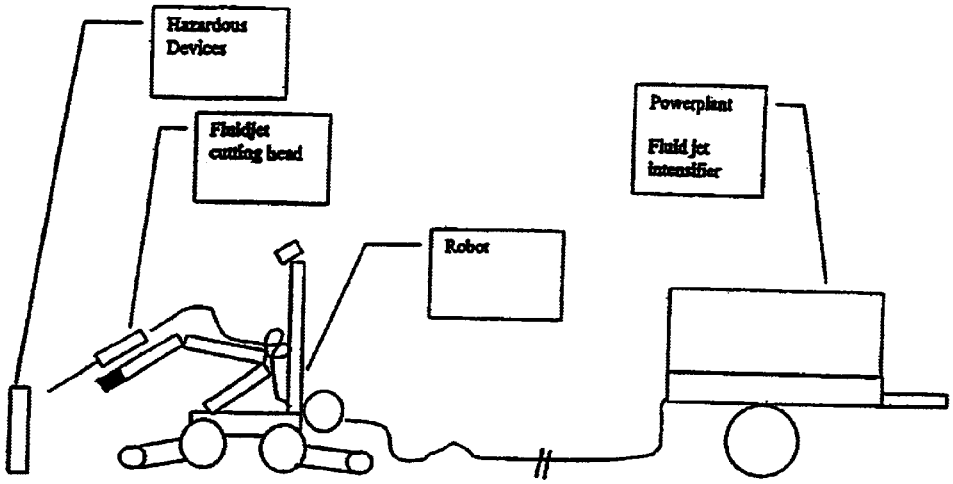
FIG. 1A shows a schematic view of an embodiment of the invention.

In FIG. 1 an apparatus 20 for the remote access of packages suspect to contain hazardous devices is shown as an autonomous unit mounted on a skid (not shown). A 25 gallon water supply reservoir 22 supplies water to a boost pump 24. The boost pump pressurizes the water to approximately 50 lbs. per sq. inch pumping it to an intensifier 26. The intensifier 26 pressurizes the water to 50,000 lbs./in$^2$. The air compressor 28 supplies the air that is necessary to operate an emergency stop pressure dump valve (not shown) and the hydroabrasive nozzle (40). A feedback loop 30 collects excess return water from the intensifier 26 and returns it to the water supply reservoir 22.

The intensifier 26 forces pressurized water through conduit 32 to a high pressure hose 34 stored on hose reel 36.

The high pressure hose terminates in a cutting nozzle 40 which includes a small diameter diamond orifice (not shown). The small diameter of the orifice (not shown) included in the cutting nozzle 40 converts the high pressure water to a high velocity continuous stream flow field which can be controlled and directed to an impact area well below the impact initiation threshold of a package suspect of containing a hazardous device. Abrasive particles are added to the high pressure water at the orifice (not shown) via an abrasive particle mixing chamber 40.1 mounted on the cutting nozzle 40. The abrasive particles enhance the cutting capacity of the high velocity flow field and are an essential component necessary for safely breaching the exterior of the package containing a suspect hazardous device. A generator set 42 provides power to the apparatus 20 thus promoting a completely autonomous unit.

Figure 2:
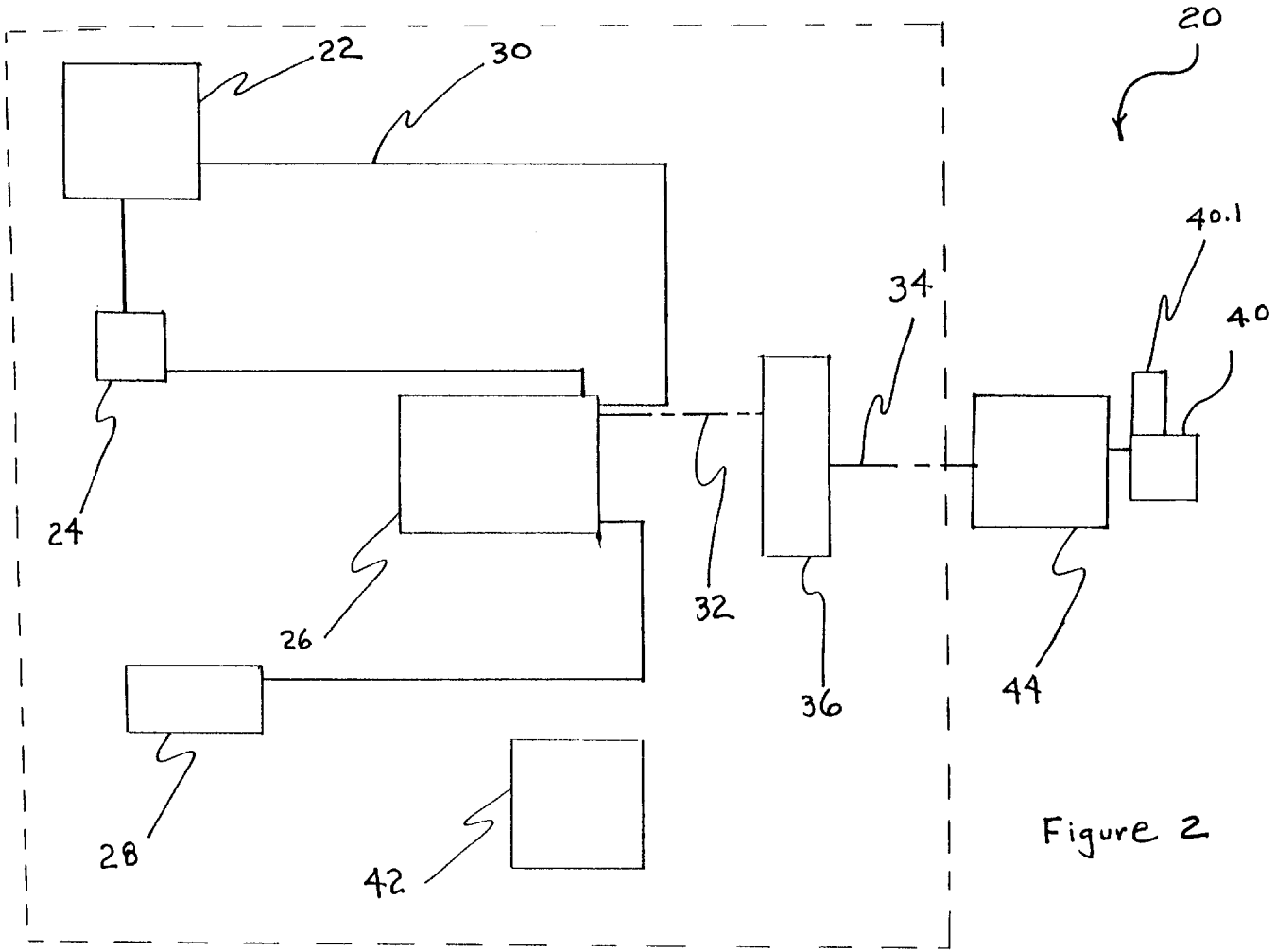
FIG. 2 shows a block diagram of an embodiment of the invention with a hazardous duty robot.

Referring to FIG. 2, the apparatus 20 can be seen with a hazardous duty robot 44 included in the design. The cutting nozzle 40 is mounted on the robot 44 and enhances safety by allowing remote operation of the hydroabrasive cutting nozzle water stream.

Figure 3:
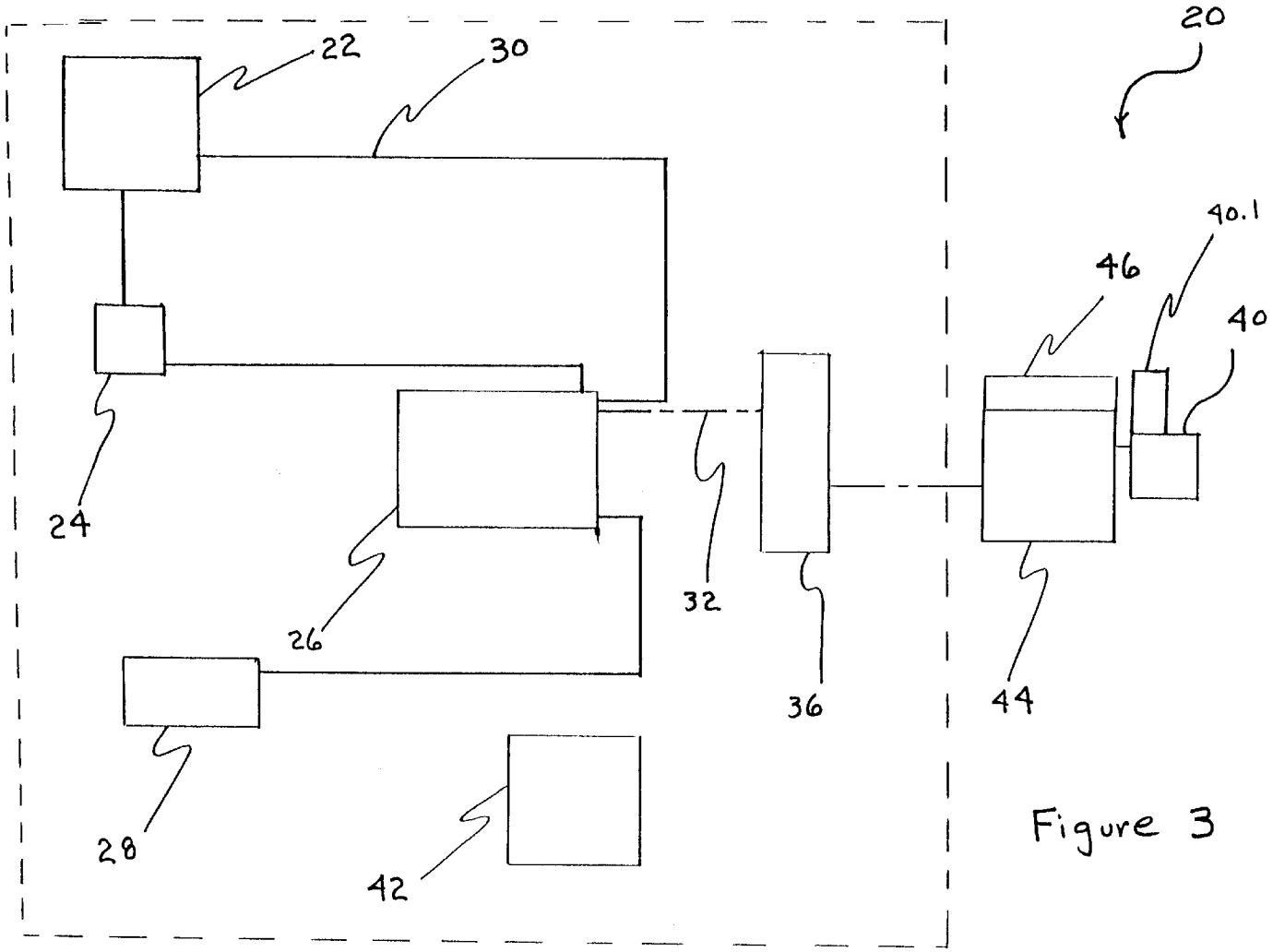
FIG. 3 shows a block diagram of an embodiment of the invention with a hazardous duty robot and an automatic standoff device.

Referring further to FIG. 3, the apparatus 20 is further enhanced with the addition of a programmable x-y stage 46. The programmable x-y stage 46 is an automatic standoff device that allows the operator of the hazardous duty robot 44 to optimally position the continuous stream of water and to more precisely control the cutting speed and impact area. In this embodiment, the programmable x-y stage 46 is removeably attached to the hazardous duty robot 44. The cutting nozzle 40 is mounted onto the programmable x-y stage 46. Once programmed, no further human intervention is required until the apparatus 20 has completed its programmed interdiction sequence. The programmable x-y stage 46 may be used without the hazardous duty robot 44 with the cutting nozzle 40 directly mounted. It is also feasible to include the programmable x-y stage 46 in a feedback mechanism of an autonomously operated vehicle containing the apparatus 20.

Those skilled in the art can now appreciate from the foregoing description that the broad teachings of the present invention can be implemented in a variety of forms. Therefore, while this invention has been described in connection with particular examples, thereof, the true scope of the invention should not be so limited since other modifications will become apparent to the skilled practitioner upon a study of the drawings, specification and following claims.

What is claimed is:

1. A method for remotely accessing packages suspect of containing hazardous devices, the method comprising the steps of:

supplying a low pressure hydro-solution from a supply reservoir to an intensifier for pressurization to a high pressure hydro-solution;

supplying the high pressure hydro-solution from the intensifier via a high pressure hose to a cutting nozzle supported by a hazardous duty robot independently moveable relative to said intensifier;

aspirating said high pressure hydro-solution from said intensifier with abrasive particles from an abrasive source which feeds abrasive to said cutting nozzle independent of said high pressure hose, to form a high pressure abrasive solution;

directing said high pressure abrasive solution through an appropriately sized orifice of said cutting nozzle so as to form a high velocity continuous stream flow field; and focusing said high velocity continuous stream flow field at a controlled speed and impact area below impact initiation threshold towards a suspect hazardous device.

2. The method according to claim 1, further comprising the step of providing water as said low pressure hydro-solution.

3. The method according to claim 1, further comprising the step of providing a gelatinous substance as said low pressure hydro-solution.

4. The method according to claim 1, further comprising the step of providing an emulsion as said low pressure hydro-solution.

5. The method according to claim 1, further comprising the step of moving a rolling platform supporting said intensifier to a location which places the continuous flow stream within reach of the suspect hazardous device with a maximum length or less of an extension of said high pressure hose.

6. The method according to claim 1, wherein the step of forming said high pressure abrasive solution by adding abrasive particles to said high pressure hydro-solution in said cutting nozzle includes feeding abrasive from an abrasive chamber mounted on said hazardous duty robot.

7. The method of claim 6 wherein abrasive is fed from a chamber having a quantity of abrasive sufficient for accessing of the suspect hazardous device.

8. The method according to claim 1, further comprising the step of mounting said cutting nozzle on an x-y programmable stage removeably attached to said hazardous duty robot for optimally directing said high velocity continuous stream flow field.

9. The method according to claim 8, further comprising the step of deploying said high velocity continuous stream flow field by utilizing said x-y programmable stage which has a pre-programmed cutting interdiction sequence which controls cutting rate and limits an impact area of said fluid jet.

10. The method according to claim 1, further comprising the step of utilizing an autonomous mobile unit as the hazardous duty robot which can be deployed to a location of said suspect hazardous device and which autonomous mobile unit includes a pre-programmed cutting nozzle pattern program.

11. The method according to claim 1, further comprising the step of pressurizing said low pressure hydro-solution to include 50,000 lbs. per square inch.

12. A method for remotely accessing packages suspect of containing hazardous devices, the method comprising the steps of:

supplying a low pressure hydra-solution from a supply reservoir to an intensifier for pressurization to a high pressure hydro-solution;

aspirating said high pressure hydra-solution from said intensifier with abrasive particles via a mixing chamber forming a high pressure abrasive solution;

directing said high pressure abrasive solution through an appropriately sized orifice forming a high velocity continuous stream flow field;

focusing said high velocity continuous stream flow field at a controlled speed and impact area below impact initiation threshold towards a suspect hazardous device, and further comprising the step of pressurizing said low pressure hydro-solution to include 50,000 lbs. per square inch.

13. A method for remotely accessing packages suspect of containing hazardous devices, the method comprising the steps of:

supplying a low pressure hydra-solution from a supply reservoir to an intensifier for pressurization to a high pressure hydro-solution;

aspirating said high pressure hydro-solution from said intensifier with abrasive particles via a mixing chamber forming a high pressure abrasive solution;

directing said high pressure abrasive solution through an appropriately sized orifice forming a high velocity continuous stream flow field;

focusing said high velocity continuous stream flow field at a controlled speed and impact area below impact initiation threshold towards a suspect hazardous device, and further comprising the step of mounting said cutting nozzle on a hazardous duty robot for remotely directing said high velocity continuous stream flow field, and providing high pressure fluid from said intensifier to said cutting nozzle via a coilable high pressure hose and feeding abrasive to said cutting nozzle from a separate abrasive source, for mixing wit fluid traveling within said cutting nozzle.

14. A method for remotely accessing an abject suspect as containing hazardous material including moving a robot, with a fluid jet cutting nozzle in fluid communication with a high pressure fluid source via a flexible high pressure hose and, in communication with a separate source of abrasive feeding into the nozzle, into a position relative to the object and breaching an exterior surface of said a aspect object with a continuous stream of a high pressure hydroabrasive solution capable of disrupting an initiating system while not presenting sufficient stimuli to initiate contents of said suspect object.

15. The method according to claim 14, further comprising the step of adding abrasive particles to said high pressure solution from a chamber source supported by said robot.

16. The method according to claim 14, further comprising the step of intensifying said continuous stream of high pressure solution by utilizing an intensifier which is connected with said flexible hose.

17. The method according to claim 14, further comprising the step of operating the robot in-situ as a remotely operated vehicle.

18. An apparatus for remotely accessing packages suspect of containing hazardous devices comprising:

a fluid supply reservoir containing fluid at a low pressure;

a pump to transfer said low pressure fluid from said fluid supply reservoir to an intensifier;

said intensifier supplying an output of regulated pressurized fluid;

a remote hazardous duty robot which supports a cutting nozzle having an orifice;

a high pressure hose, and wherein said output of regulated pressurized fluid from said intensifier is a high pressure fluid, which feeds through said high pressure hose to the orifice of said cutting nozzle forming a high velocity continuous stream flow field;

an abrasive source in abrasive feed communication wit said cutting nozzle for mixing abrasive with said high pressure fluid at said cutting nozzle;

said cutting nozzle including said orifice for focusing said high velocity continuous stream flow field with abrasive at a controlled speed and impact area below impact initiation threshold towards a suspect package; and a power generator for supplying power to said pump, and said intensifier, said generator being of a type which obviates the need for an external power source.

19. The apparatus according to claim 18, wherein abrasive particles are added to said high velocity continuous stream flow field via said cutting nozzle.

20. The apparatus according to claim 18, wherein said high pressure hose from said intensifier feeds into a hazardous duty robot for remotely directing said high velocity continuous stream flow field.

21. The apparatus according to claim 20, wherein an x-y programmable stage is removeably attached to said hazardous duly robot for remotely directing said high velocity continuous stream flow field.

22. The apparatus of claim 20 wherein said abrasive source includes a container mounted on said hazardous duty robot which container stores a sufficient quantity of abrasive for gaining access to said hazardous device.

23. The apparatus according to claim 18, wherein said high pressure hose is housed on a hose reel.

24. A method for remotely accessing suspect hazardous material, comprising:

providing a source of high pressure fluid;

providing a high pressure flexible hose in fluid communication with said source of high pressure fluid;

positioning a remotely or autonomously controlled fluid jet cutting system at a desired position relative to the suspect hazardous material, while maintaining the fluid jet cutting system in communication with said high pressure flexible hose;

providing an abrasive from an abrasive source to the controlled fluid jet cutting system;

supplying fluid derived from said source of high pressure fluid and flexible hose to said fluid jet cutting system;

mixing in situ, relative to said fluid jet cutting system, fluid from said high pressure flexible hose and abrasive from said abrasive source;

directing a stream of mixed fluid and abrasive to facilitate accessing of the hazardous material.

25. The method as recited in claim 24 wherein providing abrasive comprises providing an abrasive chamber on said remotely controlled fluid jet cutting system which stores a quantity of abrasive for carrying out accessing of the suspect hazardous material.

26. The method as recited in claim 24 wherein said source of high pressure fluid provides fluid at a pressure which includes 50,000 psi.

27. The method as recited in claim 24 wherein high pressure fluid and abrasive material are mixed in a mixing area of a cutting nozzle of said fluid jet cutting system and passed through a limiting orifice to form a fluid-abrasive cutting jet.

28. The method as recited in claim 24 wherein, during positioning of said controlled fluid jet cutting system, said source of high pressure fluid is maintained stationary as said high pressure flexible hose and remotely controlled fluid jet cutting system are moved relative to said source of high pressure fluid.

29. The method as recited in claim 28 wherein said source of high pressure fluid is supported on a wheeled platform.

30. The method as recited in claim 24 wherein said controlled fluid jet cutting system comprises a remotely operated vehicle, and a fluid jet cutting nozzle supported on said remotely operated vehicle and positioning said remotely controlled fluid jet cutting system includes moving said vehicle and cutting nozzle from a first position to a second position with said second position being closer to the hazardous material than said first position.

31. The method as recited in claim 30 wherein during the step of moving said vehicle and cutting nozzle from the first position to a second position said high pressure hose is unwound out from a storage position.

32. The method as recited in claim 30 further comprising further manipulating the position of the cutting nozzle in a cutting pattern following location at said second position.

33. The method as recited in claim 24 further comprising manipulating a position of the cutting nozzle through adjustments made in a supporting robotic arm which is supported by said controlled vehicle.

34. The method claim 24 further comprising moving said cutting nozzle through a pattern that is based on a preprogrammed pattern.

35. The method of claim 34 wherein said pattern is carried out by adjustments in an X-Y cutting nozzle support stage.

36. The method of claim 35 wherein said X-Y cutting nozzle support stage is carried out based on a preprogrammed pattern which moves said cutting nozzle at a rate which provides for a complete cut through as the nozzle travels along the pattern.

37. The method of claim 24 further comprising a standoff device, said standoff device placing said controlled fluid jet cutting system at a predetermined spacing location relative to an object to be cut by said fluid jet cutting system.

38. The method of claim 37 wherein said standoff device is an automatic standoff device including means for placing the access nozzle at the predetermined spacing location.

39. The method of claim 37 wherein said standoff device is an automatic standoff device which includes a proximity sensor and a feedback system which monitors and compensates for off position relative to the predetermined spacing location.

40. The method of claim 24 wherein a first cutting sequence is performed to visibly access the hazardous material and a second cutting sequence is carried out to access and disrupt the hazardous material.

41. The method of claim 24 wherein said flexible hose feeds into said cutting nozzle at a first nozzle input location and said abrasive feeds into said nozzle at a second, independent nozzle input location.

42. An apparatus for remotely accessing hazardous material, comprising:

a source of pressurized fluid;

a controllable vehicle;

a fluid jet cutting system supported on said controllable vehicle;

a flexible fluid conduit extending between said source and said fluid jet cutting system;

and said fluid jet cutting system including a cutting nozzle which is multipositionable relative to said controllable vehicle; and a source of abrasive in communication with the cutting nozzle of said fluid jet cutting system to introduce abrasive to a stream of fluid traveling through said cutting nozzle from said source of pressurized fluid.

43. The apparatus of claim 42 wherein said source of abrasive is an abrasive chamber which is supported by said controllable vehicle and includes an abrasive feed communication relationship with said nozzle which is independent of the flexible fluid conduit feeding fluid to said mixing chamber.

44. The apparatus of claim 42 wherein said vehicle is a remotely controlled vehicle.

45. The apparatus of claim 42 further comprising a proximity sensor which positions said fluid jet cutting system at a predetermined position relative to suspect hazardous material.

46. The apparatus of claim 42 wherein said source of pressurized fluid is supplied on a pressurized fluid support base and said apparatus further comprising an electrical generator and a support structure for a length of the flexible hose supported on said pressurized fluid support platform.

47. The apparatus of claim 46 wherein said pressurized fluid support base is a wheeled support base.

48. The apparatus as recited in claim 46 wherein the support structure for the flexible hose is a reel support for a coiled length of said flexible hose.

49. The apparatus as recited in claim 46 wherein said source of pressurized fluid is a high pressure source which includes 50,000 psi and said hose is a high pressure hose designed to handle the high pressure fluid supplied by said high pressure source.

50. The apparatus as recited in claim 46 wherein said fluid jet cutting system includes a multi-axis robotic arm supported by said vehicle and supporting the fluid jet cutting nozzle.

51. The apparatus as recited in claim 50 further comprising a program processor for moving said cutting nozzle through a cutting pattern while supported on said vehicle.

52. The apparatus as recited in claim 51 wherein said vehicle includes a location sensing means for locating said vehicle at a desired location relative to the object to be subjected to fluid-jet cutting and said apparatus comprises means for manipulating the cutting nozzle in a cutting pattern based on a spacing provided by said locating means.

53. The apparatus of claim 46 further comprising an X-Y stage which support said cutting nozzle and is programmable to carry out a predetermined cutting pattern and is supported by said vehicle.

54. The apparatus of claim 43 wherein said abrasive chamber has a capacity for storing a quantity of abrasive sufficient for accessing of the suspect hazardous material.

* * * * *